US007120093B2

(12) United States Patent
Lazaretnik

(10) Patent No.: US 7,120,093 B2
(45) Date of Patent: Oct. 10, 2006

(54) OVAL SHAPED TIMEPIECES AND STEM ARRANGEMENT FOR WATCHES

(76) Inventor: Daniel Lazaretnik, 160 Central Park S., #660, New York, NY (US) 10019

( * ) Notice: Subject to any disclaimer, the term of this patent is extended or adjusted under 35 U.S.C. 154(b) by 28 days.

(21) Appl. No.: 10/783,300

(22) Filed: Feb. 20, 2004

(65) Prior Publication Data

US 2005/0185516 A1 Aug. 25, 2005

(51) Int. Cl.
*G04B 19/04* (2006.01)
*G04B 19/06* (2006.01)

(52) U.S. Cl. ..... 368/80; 368/223; 368/228; D10/39

(58) Field of Classification Search ..... 368/76, 368/80, 223, 228, 21, 28, 220, 282, 309; D10/39

See application file for complete search history.

(56) References Cited

U.S. PATENT DOCUMENTS 1,505,521 A * 8/1924 Kresser ..... 368/232
1,997,511 A * 4/1935 Canepa ..... 368/18
2,179,294 A * 11/1939 Heit ..... 368/285
3,277,646 A * 10/1966 Howard, Sr. ..... 368/281
3,672,157 A * 6/1972 Manceri ..... 368/282
D258,120 S * 2/1981 Muramatsu ..... D10/39
4,655,606 A * 4/1987 Giger ..... 368/160
5,339,293 A * 8/1994 Kamiyama et al. ..... 368/21
D363,882 S * 11/1995 Bodino ..... D10/32
5,490,123 A * 2/1996 Biver ..... 368/295
D453,690 S * 2/2002 D'Origny ..... D10/39
D465,739 S * 11/2002 Arabov ..... D10/39
D487,230 S * 3/2004 Dubarry ..... D10/39
D500,452 S * 1/2005 Itsubo ..... D10/39
6,847,589 B1 * 1/2005 Wilmouth ..... 368/17
2003/0151980 A1 * 8/2003 Farash ..... 368/21

* cited by examiner

*Primary Examiner*—Vit W. Miska
(74) *Attorney, Agent, or Firm*—Ostrolenk, Faber, Gerb & Soffen, LLP

(57) ABSTRACT

A watch frame comprising a dial face having a circumferential boundary surrounding the dial face. A single series of hours indicia are arranged along and following the circumferential boundary and surrounding an interior region of the dial face. A first and second time movement, each including respective hour and minute handles are arranged in spaced relationship to each other with the hours and minute handles or each movement operating in conjunction with said single series of hours indicia. A first three stem arrangement coupled to and controlling the first time movement and a second three stem arrangement coupled to and controlling the second time movement having a polygonal shape to compliment that of the watch face.

17 Claims, 9 Drawing Sheets

OVAL SHAPED TIMEPIECES AND STEM ARRANGEMENT FOR WATCHES

BACKGROUND OF THE INVENTION

The present invention relates to timepieces and, more particularly, to a dual analog or analog-style watch employing a single dial face having a single series of hours indicia.

The art of watchmaking and designing is a highly developed art which has progressed over hundreds of years. Therefore, creating a watch's timekeeping movements, whether implemented entirely mechanically, or as a combination of electronic circuitry and mechanical parts, is widely known and within easy reach of a person of ordinary skill in the art and, as such, does not require further explanation herein.

The marketing and promotion of various timepieces are therefore driven by appearance and design aspects, as well as various add-on functionality of watches, by which manufacturers and suppliers of watches distinguish their wares from one another.

SUMMARY OF THE INVENTION

Accordingly, it is an object of the present invention to provide a novel chronometer and/or chronograph watch of unique functionality and arrangement.

Also, it is an object of the present invention to provide a dual chronometer and/or a dual chronograph watch that utilizes a single dial face and dual time movements having controls that are implementable with existing technology.

Additionally, it is an object of the present invention to increase the likelihood of visibility of an analogue display regardless of a profile viewing angle or of a partially covered dial face.

Furthermore, the present invention aims to simultaneously provide dual time-zone timekeeping capabilities without having a second series of hours indicia cluttering the dial face.

Moreover, the present invention seeks to provide the capability of tracking the day and/or date of the week in two time-zones.

Also, the present invention provides the capability of concurrently tracking the elapsed times of two phenomena.

Additionally, the present invention provides a dial face having a large surface area capable of displaying an insignia or design with high visibility.

Furthermore, the present invention provides a large dial face and surrounding bezel having a large surface area for receiving an increased number of precious or semiprecious stones with high visibility.

Still further, the present invention provides a unique stem arrangement incorporating two pairs of three stemmed controls, wherein an outer contour of each stemmed control defines a geometrical polygonal shape which is harmonized with the outer polygonal shapes of the watch itself.

The foregoing and other objects of the invention are realized with a preferred watch frame construction having a top and bottom side connected and enclosed by a series of peripheral side walls arranged relative to one another to define a polygonal twelve-faced perimetral wall. The top side having a large oval dial face with a circumferential boundary surrounds the dial face and a large oval bezel surrounds the circumferential boundary of the dial face. The dial face and the bezel provide a large surface area for receiving an insignia or design, which may additionally be adorned with precious or semiprecious stones.

A single series of hours indicia is arranged around and along the circumferential boundary of the dial face, surrounding an interior region of the dial face. Aesthetically, the hours indicia may be in the form of dashes, arabic numerals, or roman numerals ranging from one through twelve. Additionally, the hours indicia may be selectively provided to further decrease any clutter on the dial face.

Two analogue time movements, either chronograph or chronometer, are arranged in spaced relationship to each other on the interior region of the dial face. Each time movement having an hours handle, a minute handle, and possibly another handle for pointing to the single series of hours indicia. Having more than one time movement and arranging them alongside one another provides a user with many functional and aesthetic advantages.

For the world traveler, the dual time movements of the present invention allow the user to concurrently track time in two different time zones with the added benefit of diminished clutter on the dial face because only one series of hours indicia are on the dial face. For example, the user would selectively use a first control stem couple to and controlling the first time movement and located at one side of the perimetral wall, to set the first time movement's hour and minute handles at a desired point on the series of hours indicia to represent the time in New York. The user would then use a second control stem, coupled to and controlling the second time movement and located at another side of the perimetral wall, to set the hour and minute handles of the second time movement at a second desired point on the series of hour indicia to show the actual time in Paris. The user could then determine the actual time in New York by mentally capturing a first image of the first time piece and mentally moving the first captured image toward a geometric center of the dial face within the interior region. The user would then read the hours indicia pointed to by the minute and hour handles of the first time movement to determine the actual time in New York. Similarly, the user determines the actual time in Paris, at the same instant of time by mentally capturing a second image of the second time piece, mentally moving this second captured image toward the center of the dial face, and reading the hours indicia pointed to by the minute and hour handles of the second time movement. Furthermore, a first and second day and/or date indicators are positioned on the dial face for tracking the day of the week represented by the respective time piece.

Provided with chronograph capabilities, a user can concurrently track elapsed times of first and second phenomena. With chronograph capabilities, a first and second set of timers, each set having three circular displays, are positioned on the interior region of the dial face. Each circular display has a centrally mounted counter handle capable of counting seconds, minutes, hours, hundredths of a second, tenths of a second, seconds, or any other desired time increment.

A third and fourth stem respectively located at a third and fourth one of the perimetral walls, respectively control and are coupled to the first and second timer sets for performing a reset function. When the third and fourth stem controls are pressed the respective counter handles are positioned at a starting point. A fifth and sixth stem, located at a fifth and sixth one of the perimetral walls, respectively control and are coupled to the first and second timer sets to perform a start/stop function. For example, pressing the fifth stem control initiates an elapsed time count by the counter handles of the first timer set by sending the respective counter handles in motion. Pressing the fifth stem a second time stops the motion of the first timer set's counter handles so that the user can read the first set of circular dials to determine the elapsed time of the first phenomena. Controlling the sixth stem provides equivalent functionality to the second timer set as the fifth control did to the first timer set so that the user can determine the elapsed time of the second phenomena.

Dual time movements also provide added visibility. For example, if the user is wearing a long sleeved shirt that partially covers the dial face of the watch, there is a greater possibility that one of the analogue displays remains in sight.

Other features and advantages of the present invention will become apparent from the following description of the invention which refers to the accompanying drawings.

DETAILED DESCRIPTION OF PREFERRED EMBODIMENTS OF THE INVENTION

Figure 1A:
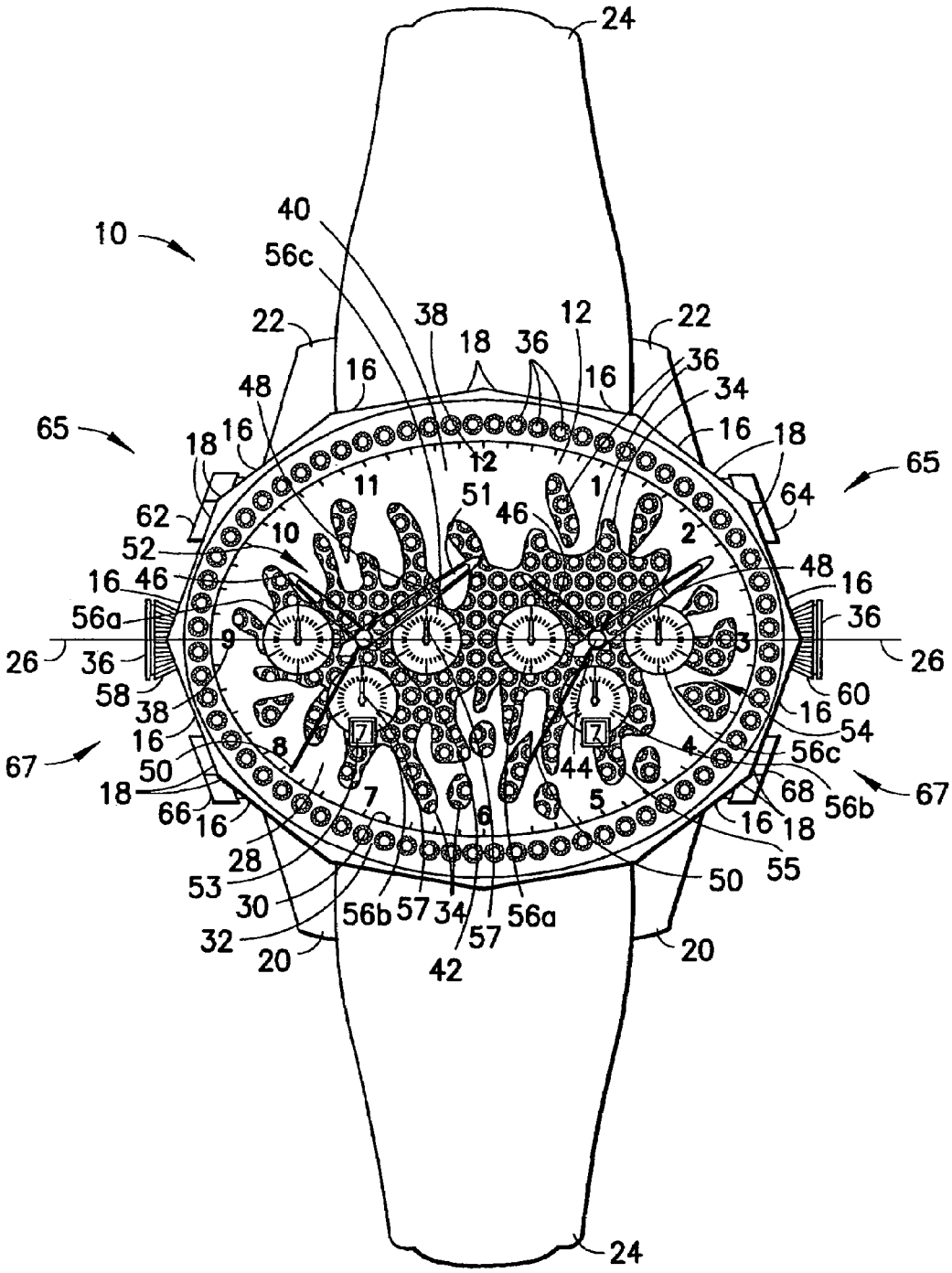
FIGS. 1*a* through 1*d* illustrate top views of a watch frame of the present invention having a band connected perpendicularly to a long axis of the watch frame.

The present invention provides a novel chronometer and/or chronograph watch of unique functionality and arrangement. FIGS. 1*a* through 6*b* use like reference numerals to reference similar features throughout.

FIGS. 1*a* through 1*d* illustrate top views of a watch frame 10 of the present invention having a top side 12 and a bottom side 14 (see FIGS. 3*a* and 3*b*) enclosed by a series of peripheral walls 16 arranged relative to one another to define a polygonal twelve-faced perimetral wall 18. A first and second pair of band mounts 20 and 22 respectively extend from opposing portions of wall 18 for receiving a band 24 perpendicular to a long axis 26 of watch frame 10. Band 24 may consist of plastic, rubber, cloth, steel, platinum, silver, gold or any other suitable material.

Side 12 of watch frame 10 has a large oval dial face 28 which has a circumferential boundary 30. Surrounding the circumferential boundary 30 is a large oval bezel 32. Dial face 28 and bezel 32 provide a large surface area for receiving an insignia or design 34, and/or may be adorned with precious or semiprecious stones 36 defining the insignia.

A single series of hours indicia 38 is arranged around and along the circumferential boundary 30 of dial face 28 and surrounds an interior region 40 of dial face 28. The series of hour indicia 38 may include fluorescent ink for visibility in the dark.

A first and a second analogue time movement 42 and 44 respectively, are arranged in spaced relationship to each other on the interior region 40 of dial face 28 along long axis 26 of watch frame 10. Both time movements 42 and 44 have an hour handle 46, a minute handle 48, and a second handle 50 for pointing to the single series of hours indicia 38. Handles 46, 48, and 50 have a tip region 51 at their distal end that is treated with a glow in the dark ink for added visibility in low light conditions. Tips 51 may also be adorned with precious or semiprecious stones 36. A first date indicator 53 is coupled to and controlled by time movement 42, and is provided on interior region 40 of dial face 28 for tracking the day of the week corresponding to time movement 42. Likewise, a second date indicator 55 is coupled to and controlled by time movement 44, and is provided on interior region 40 of dial face 28 for tracking the day of the week corresponding to time movement 44. Because both indicators 53 and 55 are controlled by separate time pieces 42 and 44, they can display numerals representing different dates.

Provided on interior region 40 are a first and a second set of chronograph timers 52 and 54 respectively. Timers 52 and 54 count elapsed time of a first and second phenomena respectively. Each set 52 and 54 has three circular displays 56*a* through 56*c* which have a centrally mounted counter handle 57 that is capable of counting seconds, minutes, hours, hundredths of a second, tenths of a second, seconds, or any other desired denomination of time. Therefore, for example, both timer sets 52 and 54 can have display 56*a* counting seconds, display 56*b* counting minutes, and display 56*c* counting hours or any other combination thereof to represent the elapsed time of the first or second phenomena.

A first crown stem 58 is coupled to and controls first time movement 42. A second crown stem 60 is coupled to and controls second time movement 44. Crowns 58 and 60 respectively extend in opposite directions from perimetral wall 18 along long axis 26 of frame 10. Crowns 58 and 60 control and/or wind first and second clock mechanisms for time movements 42 and 44 respectively. A distal end of stem 58 is adorned with a precious or semiprecious stone 36. Likewise, a distal end of stem 60 is adorned with a precious or semiprecious stone 36. Long axis 26 divides watch frame 10 into a first and a second hemisphere 65 and 67 respectively.

A third stem crown 62 controls and is coupled to timer set 52. A fourth stem crown 64 controls and is coupled to timer set 54. Third and fourth stems 62 and 64 extend from hemisphere 65 of wall 18 in opposite directions for controlling a reset function of the timer sets 52 and 54 respectively. Pressing third and fourth stem controls 62 and 64 drives counter handles 57 of timers 52 and 54 respectively to an initial timing position 59 and thereby resets timers 52 and 54.

A fifth stem crown 66 controls and is coupled to timer 52 for controlling a start/stop function of timer 52. A sixth stem crown 68 controls and is coupled to timers 54 for controlling a start/stop function of timer 54. Fifth and sixth stems 66 and 68 respectively extend in opposite directions from hemisphere 67 of wall 18. Pressing stem 66 initiates an elapsed time count by counter handles 57 of timer 52 by sending the respective counter handles 57 in motion. Pressing stem 66 again stops the motion of the first set's 52 counter handles 57 so that the user can read circular displays 56*a* through 56*c* of the first timer 52 to determine the elapsed time of the first phenomena. Controlling stem 68 provides functionality to timer 54 equivalent to the functionality provided by stem 66 for timer 52, thereby allowing the user to determine the elapsed time of the second phenomena.

FIG. 1*a* illustrates a full periphery of precious stones 36 attached to bezel 32. Interior region 40 of dial face 28 is adorned with a design 34 in the form of a waterdrop.

Waterdrop design 34 is further adorned with precious stones 36. Additionally, the single series of hours indicia 38 is in the form of arabic numerals ranging from one to twelve.

Figure 1B:
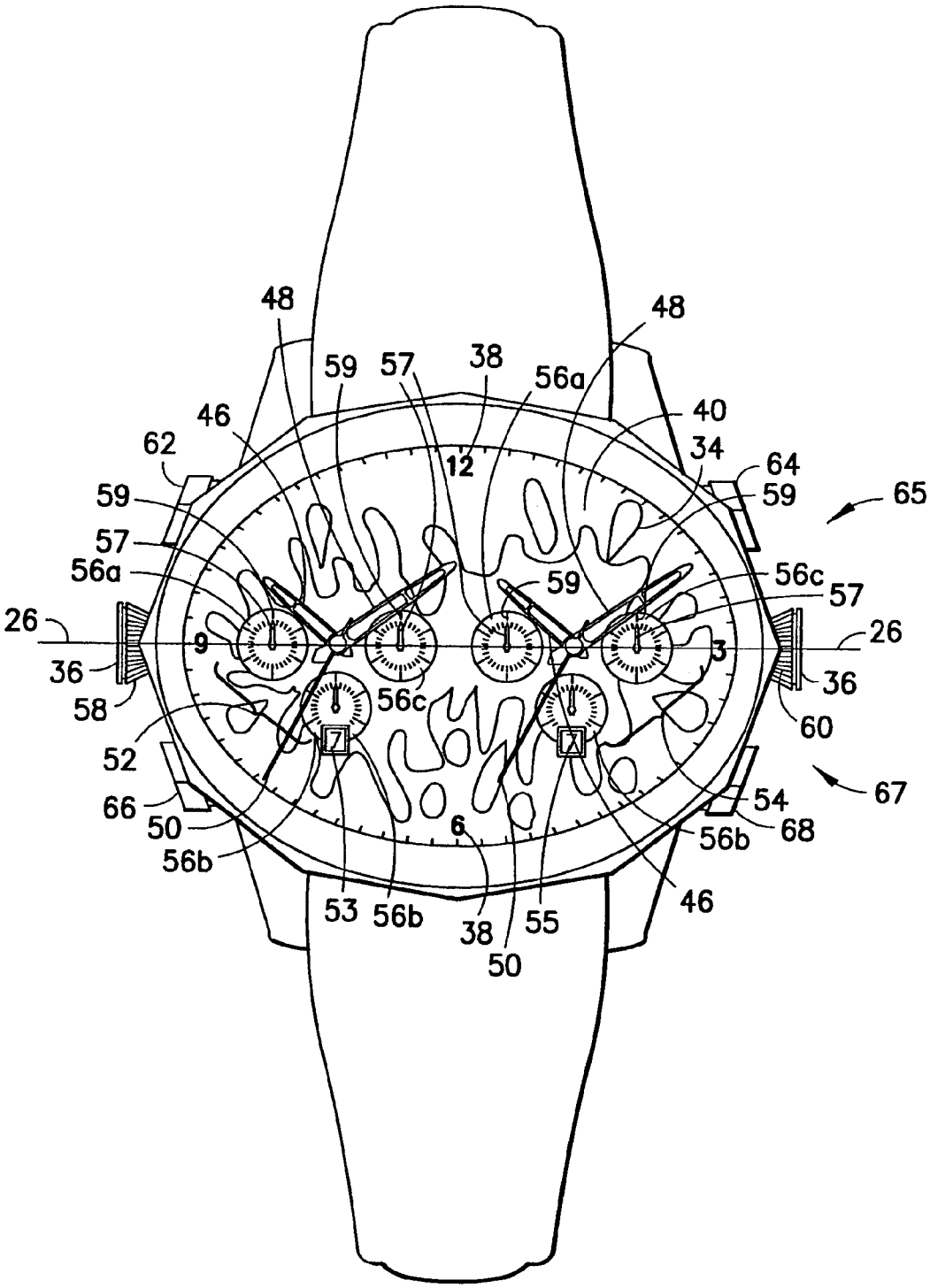

FIG. 1*b* illustrates a slight variation of dial face 28 and bezel 32 from FIG. 1*a*. Here, waterdrop design 34 and bezel 32 lack the adornment of precious or semiprecious stones 36. However, color print, etching, or other markings or adhesives may be used to create the watersplash design 34 on dial face 28. Additionally, the series of hours indicia 38 only includes the numerals, twelve, three, six and nine.

Figure 1C:
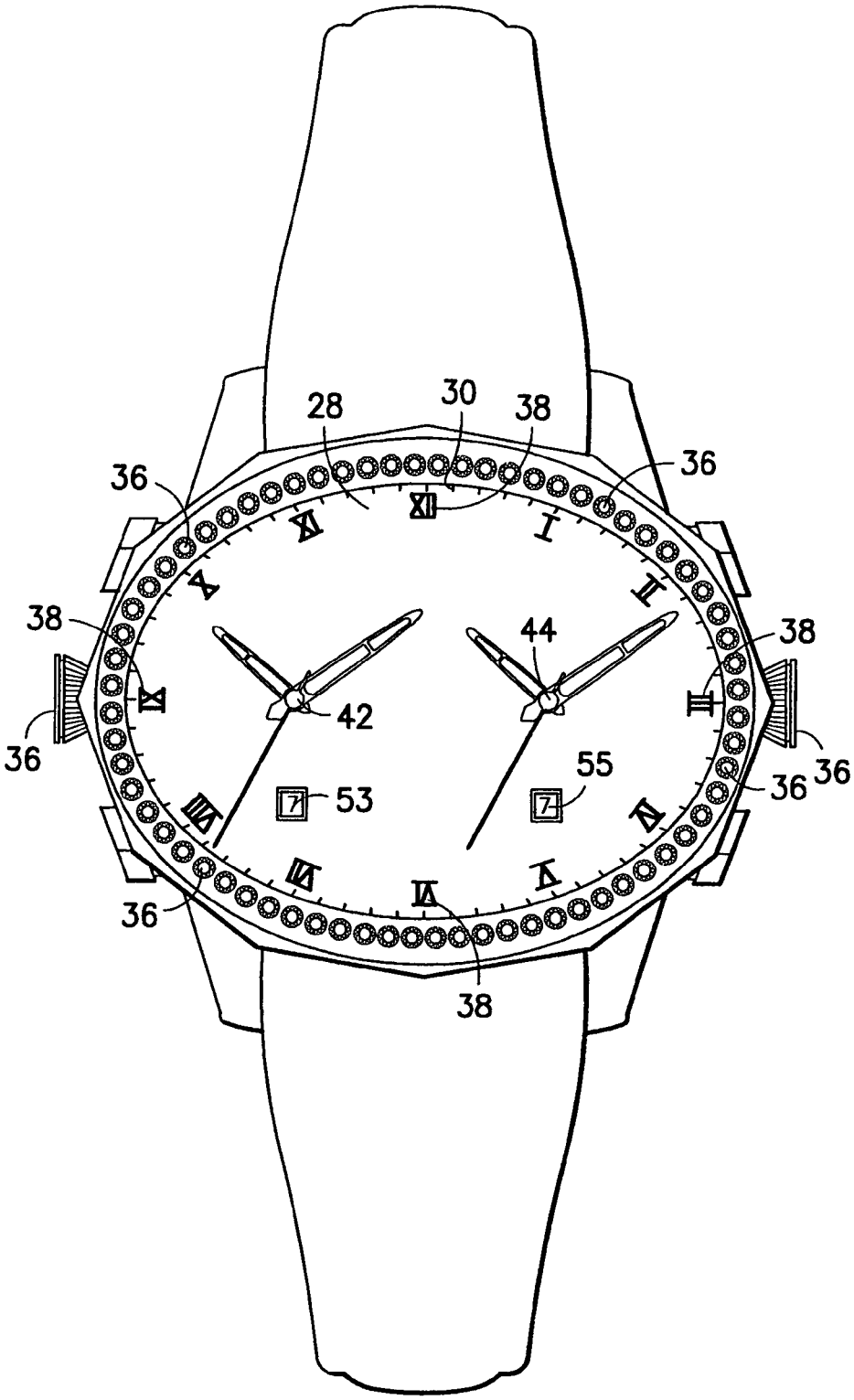

In another variation, FIG. 1*c* illustrates the use of roman numerals for the series of hour indicators 38, and incorporates precious stones 36 along the entire surface area of the bezel 32. Additionally, FIG. 1*c* illustrates watch 10 without chronograph timers 52 and 54 and the associated circular dials 56*a* through 56*c* and without waterdrop design 34.

Figure 1D:
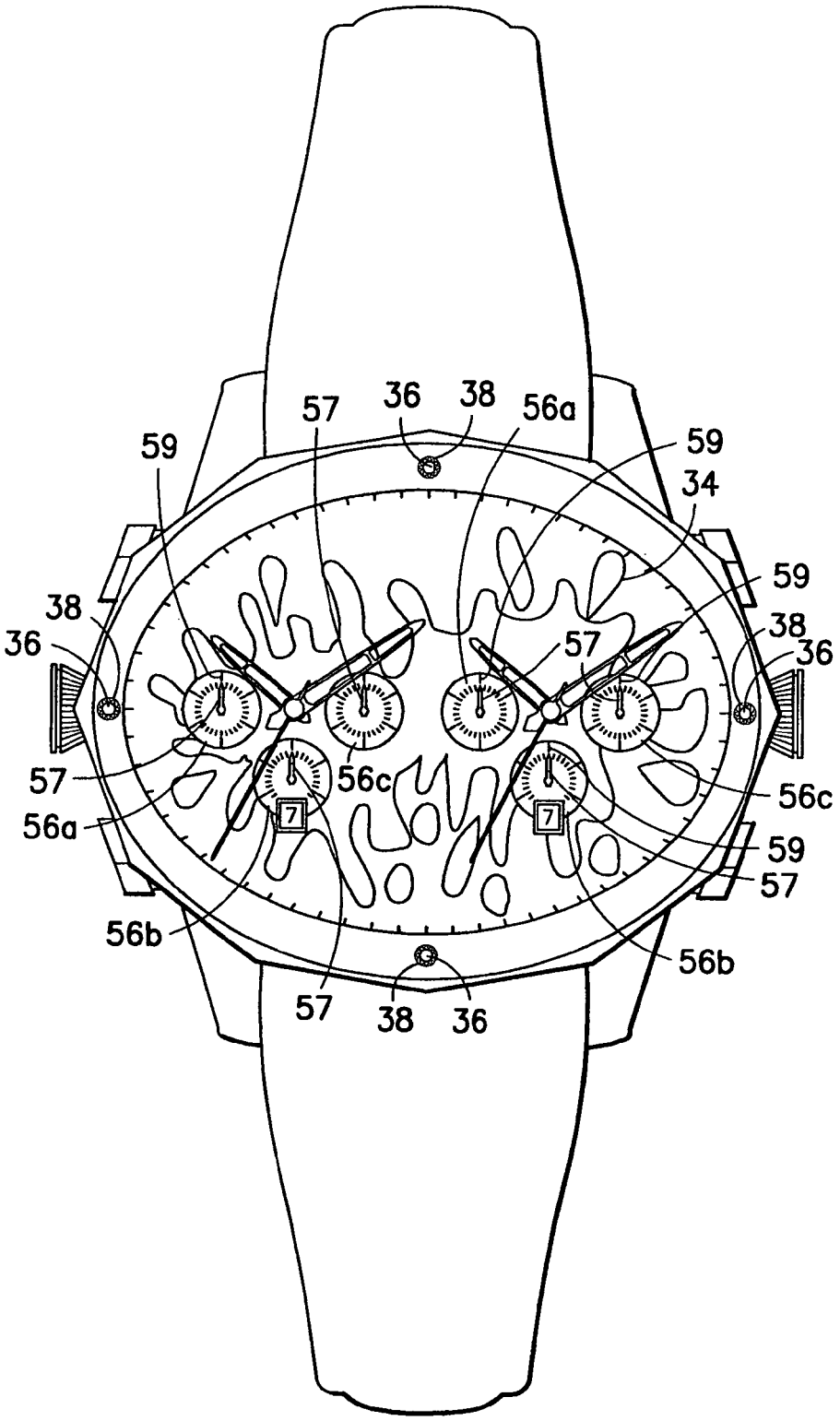

Referring to FIG. 1*d*, precious stones 36 are strategically placed on bezel 32 so that they act as a series of hours indicia 38 in their own right, and thereby eliminate cluttering of the dial face 28 by a series of hour indicia 38 being printed thereon.

Figure 2A:
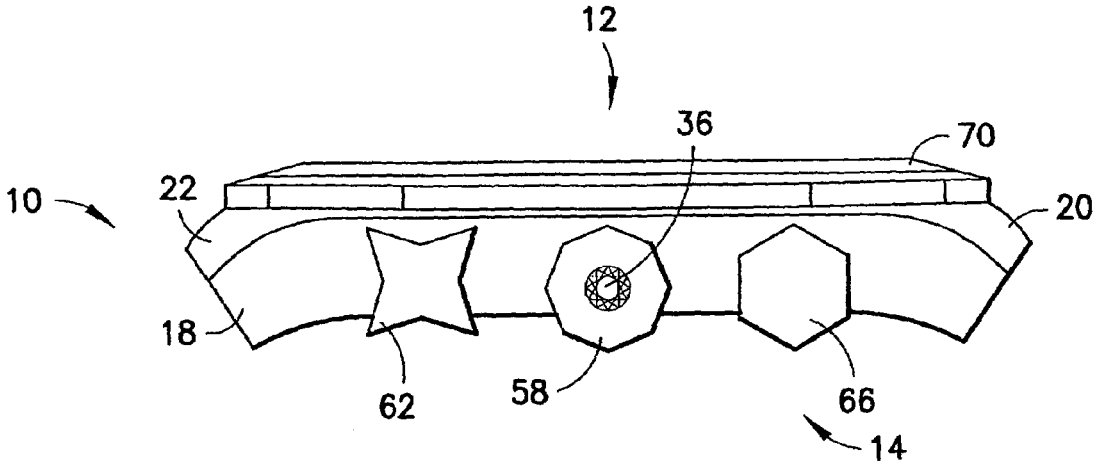
FIG. 2*a* illustrates a left side view of the watch frame of the present invention having a flat crystal.

FIG. 2*a* illustrates a left side view of watch 10. Shown in the first, third, and fifth stem controls 58, 62 and 66 receptively. For stylistic purposes, the outer contours of these stems 58, 62, and 66 are defined by geometrical polygonal shapes that are harmonized with the outer polygonal shapes of watch 10. Each stem 58, 62, and 66 is shown to be a graspable knob which has a polygonal shape of at least six sides. A center of the distal end of stem 58 is adorned with a precious stone 36. Covering dial face 28 on top surface 12 is a crystal 70. Here, the profile of the crystal 70 is substantially flat. Similarly, if frame 10 was curved to conform to the curvature of a wrist, the crystal 70 would curve therewith yet would still not substantially extend from top side 12.

Figure 2B:
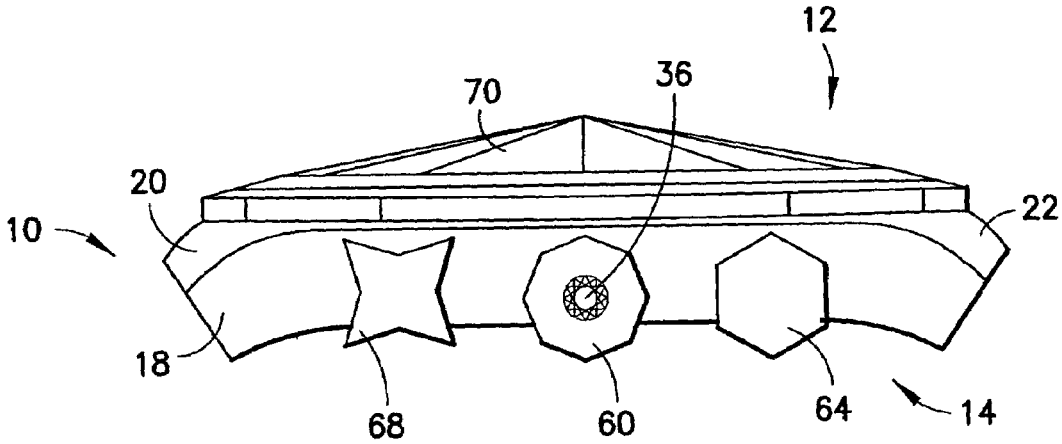
FIG. 2*b* illustrates a right side view of a watch frame of the present invention having a raised, diamond-shaped crystal.

FIG. 2*b* illustrates a right side view of watch 10. There is shown the second, fourth, and sixth stem controls 60, 64 and 68 receptively. For stylistic purposes, the outer contours of these stems 60, 64, and 68 are defined by geometrical polygonal shapes which are harmonized with the outer polygonal shapes of watch 10. Each stem 60, 64, and 68 is shown to be a graspable knob having a polygonal shape of at least six sides. A center of the distal end of stem 60 is adorned with a precious stone 36. Here, the profile of crystal 70 extends upward from top surface 12 in a pyramidal or diamond like shape.

Figure 3A:
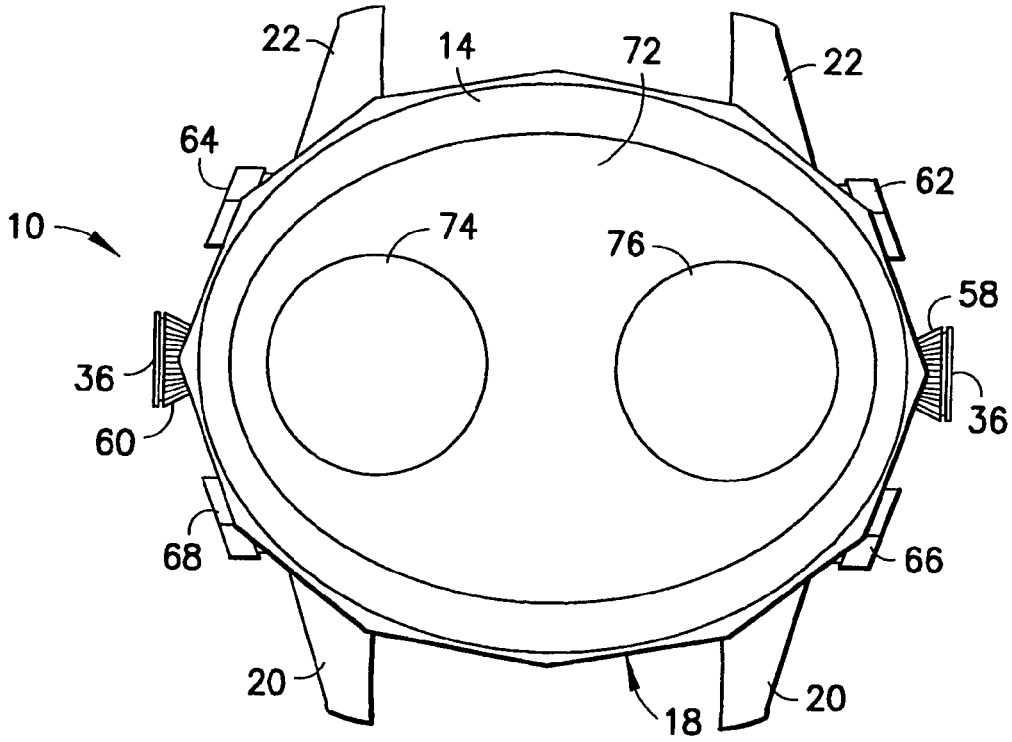
FIGS. 3*a* and 3*b* illustrate bottom views of the watch frame of the present invention.
Figure 3B:
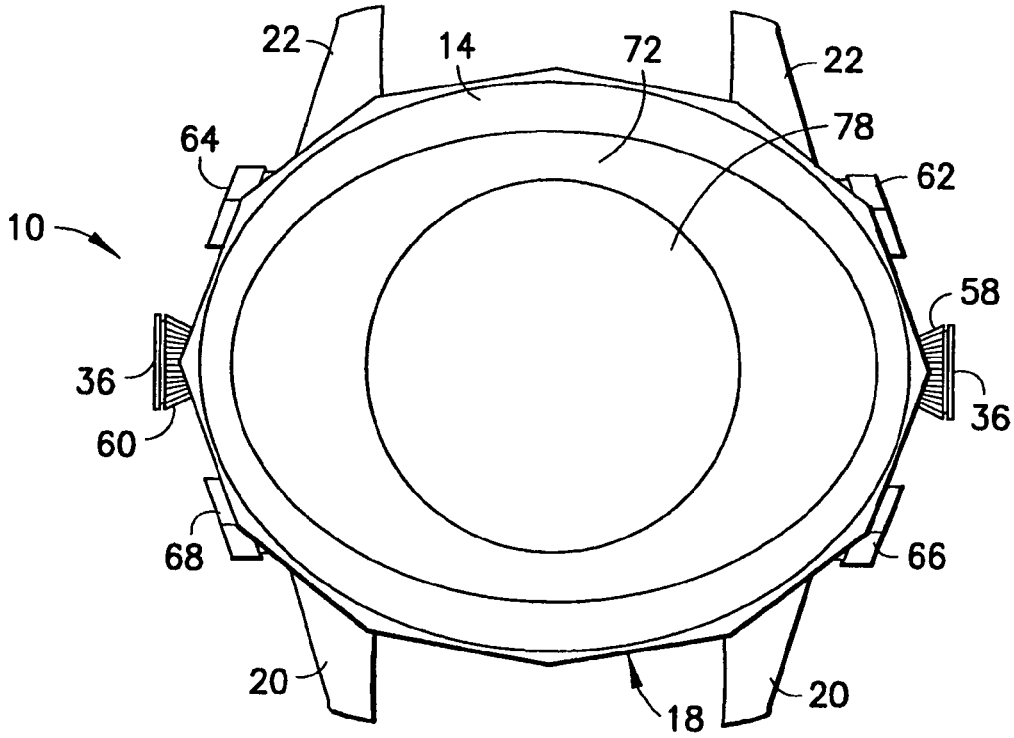

Referring to FIGS. 3*a* and 3*b*, and the bottom view associated therewith, there is illustrated a chamber 72 centrally mounted in watch frame 10 for encasing the internal mechanisms associated with the operation of the time movements and chronometers of watch 10. In FIG. 3*a*, a first and second access panel 74 and 76 respectively are provided in chamber 72 for accessing a first and second power source for separately driving the first and second time pieces. In FIG. 3*b*, illustrated is one large access panel 78 in the chamber 72 for accessing a unified power source for driving both the first and second time pieces in the watch 10.

Figure 4:
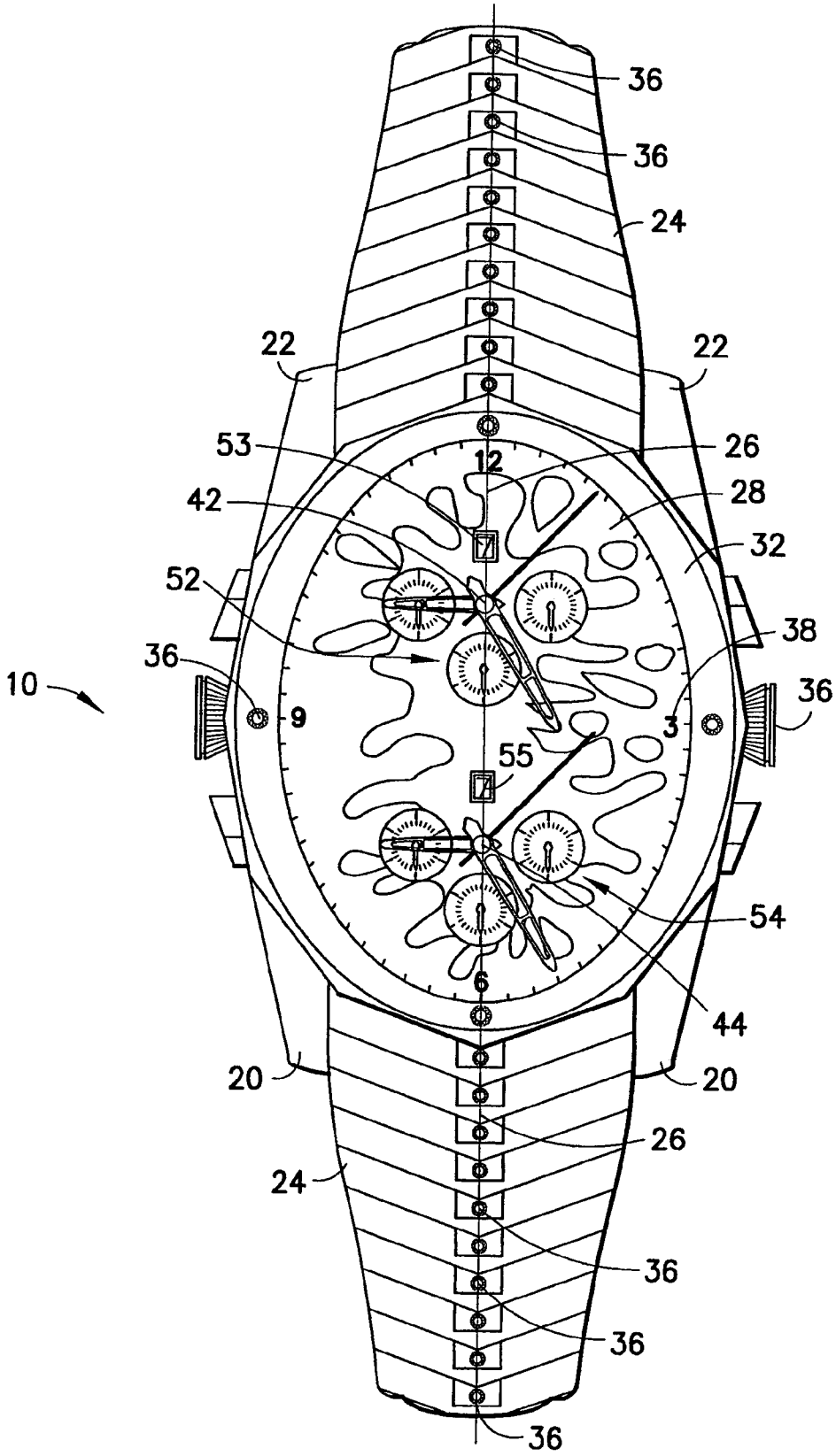
FIG. 4 illustrates a top view of the watch frame of the present invention connected to a metallic band along the long axis of the watch frame.

FIG. 4 illustrates a top view of a variant configuration of watch 10. The illustrated watch 10 is similar to those illustrated in FIGS. 1*a* through 1*d*; however, band mounts 20 and 22 extend along long axis 26 of watch 10, and not perpendicular thereto. Also, band 24 is shown to consist of platinum with precious stones 36 embedded therein.

Figure 5:
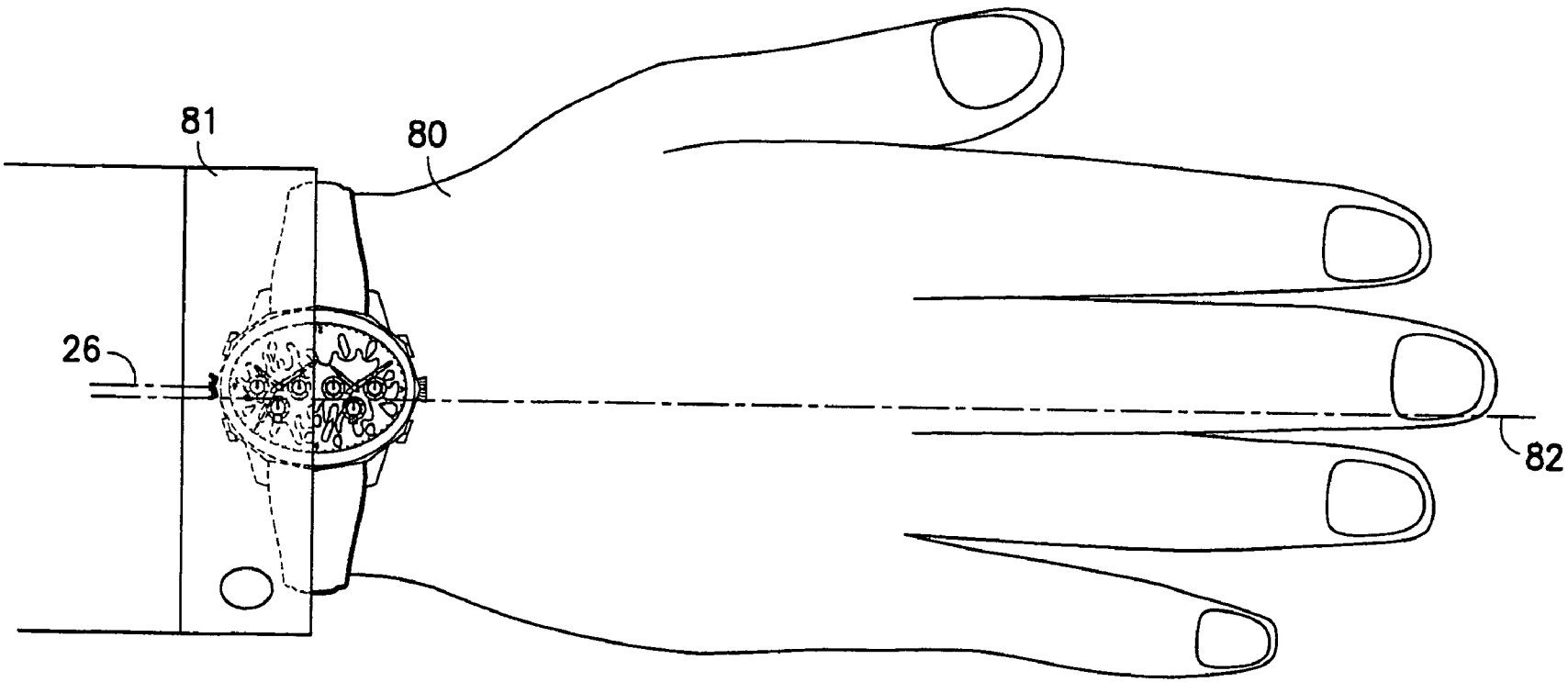
FIG. 5 illustrates a top view of the watch of the present invention, as illustrated in FIG. 1*b*, worn on a wrist of a user.

FIG. 5 illustrates a top view of the embodiment of watch 10 as shown in FIG. 1*b* being worn on a wrist of a user 80. The user is wearing a long sleeved shirt 81 that partially covers oval dial face 28 of watch 10. Because time movements 42 and 44 are arranged in spacial relationship along long axis 26 of the oval dial face 28 and long axis 26 is aligned with a longitudinal axis 82 of the wrist of the user 80 there is a greater possibility that one of the analogue displays 42 or 44 remains in site.

Figure 6A:
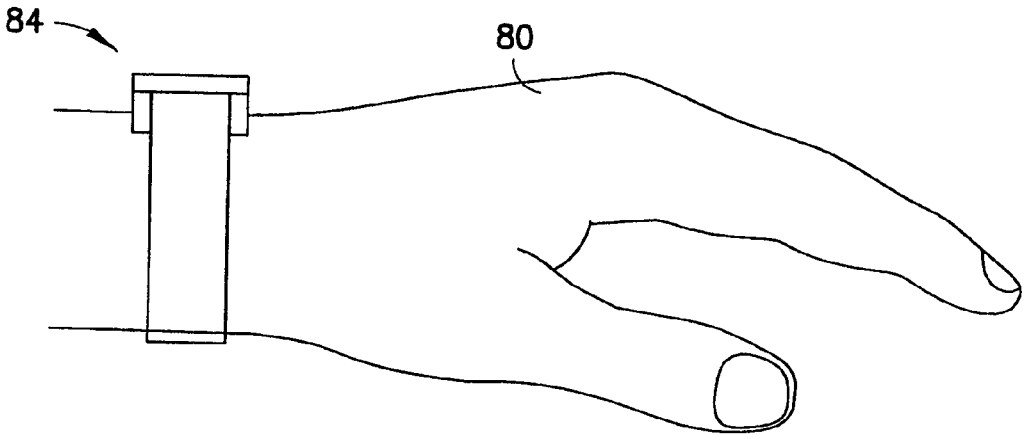
FIG.6a PRIOR ART
FIGS. 6*a* and 6*b* respectively illustrate a side view of a traditional watch and a side view of the watch of the present invention as illustrated in FIG. 4 being worn on the wrist of the user.

FIG. 6*a* illustrates a profile view of a traditional single analogue watch 84. The dial face of a traditional single analogue watch 84 is not visible from a profile because it is not large and oval shaped with a longitudinal axis perpendicular to the longitudinal axis 82 of the user's wrist 80.

Figure 6B:
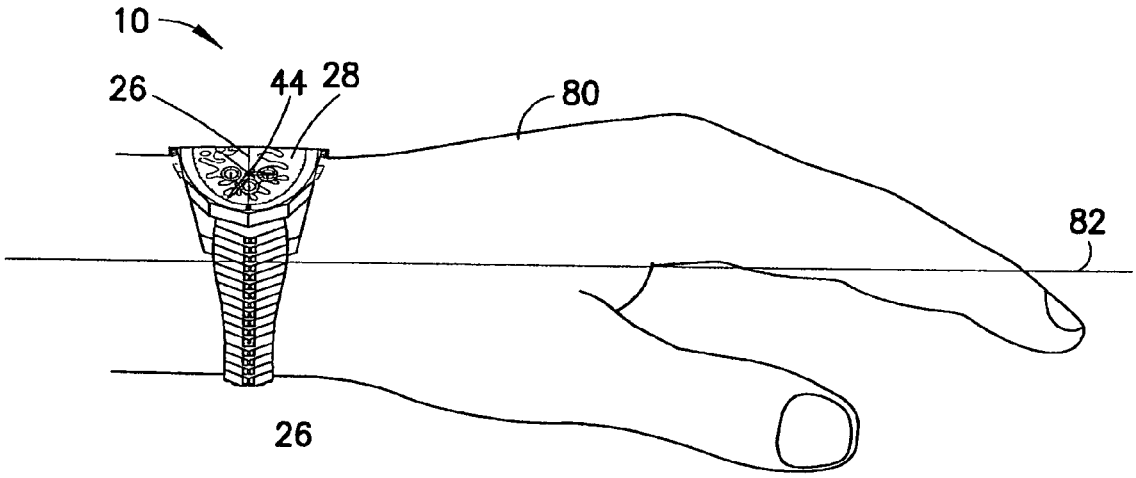

FIG. 6*b* illustrates a user wearing an embodiment of watch 10 as illustrated in FIG. 4. Here, time movement 44 and a portion of dial face 28 are visible from a profile because long axis 26 of watch 10 runs perpendicular to longitudinal axis 82 of the user's wrist 80.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A timepiece, comprising:

a dial face having a circumferential boundary surrounding the dial face and having a geometric center;

a series of hours indicia arranged along and following the circumferential boundary and surrounding an interior region of the dial face;

a first time movement including respective hour and minute handles rotating about a respective center of the first time movement and having no hours indicia centered on the center of the first time movement;

a second time movement including respective hour and minute handles rotating about a respective center of the second time movement and having no hours indicia centered on the center of the second time movement;

wherein said first and second time movements are arranged in spaced relationship to each other, and each of said movements being settable and running independently of one another and further being spaced away from the geometric center of the dial face, and wherein the circumferential boundary is oval shaped and the centers of said time movements are spaced along a long axis of the dial face and wherein said minute handles of said time movements together span said oval shaped dial face; and a watch band aligned with a short axis of said oval shaped dial face.

2. The timepiece of claim 1, wherein said series of hours indicia includes at least the numerals 12, 3, 6 and 9.

3. The timepiece of claim 1, further including bezel extending about the circumferential boundary.

4. The timepiece of claim 3, in which the bezel comprises precious or semiprecious stone mountings.

5. The timepiece of claim 4, in which the bezel is oval shaped.

6. The timepiece of claim 1, further including a first three stem arrangement coupled to and controlling the first time movement and a second three stem arrangement coupled to and controlling the second time movement.

7. The timepiece of claim 6, in which the first three stem arrangement is located to a left side of the first time movement and the second three stem arrangement is located to a right side of the second time movement.

8. The timepiece of claim 6, in which each of the stems of the first stem arrangement and of the second stem arrangement has a graspable knob which has a polygonal shape of at least six sides.

9. The timepiece of claim 8, in which each of the stems of said first time movement has a fancifully shaped polygonal periphery.

10. The timepiece of claim 1, further including a first dial, second dial and a third dial, each with a single respective handle, the first, second and third dials being located on the dial face adjacent the first movement for indicating, respectively, hours, minutes and seconds.

11. The timepiece of claim 1, further including a first dial, second dial and a third dial, each with a single respective handle, the first, second and third dials being located on the dial face adjacent the second movement for indicating, respectively, hours, and minutes and seconds.

12. The timepiece of claim 1, further including a first date indicator associated with the first time movement and a second, independently operable, date indicator associated with the second movement.

13. The timepiece of claim 10, further including a first date indicator associated with the first time movement and a second, independently operable, date indicator associated with the second movement.

14. The timepiece of claim 1, further including a precious or semiprecious stone setting located on interior region of the dial face having a plurality of precious or semiprecious stones mounted in the setting, so as to cover a predetermined region on said dial face with gemstones.

15. The timepiece of claim 14, in which the precious or semiprecious stones are diamonds.

16. The timepiece of claim 14, in which the setting on the dial face covered with precious or semiprecious stones has a water splash shape.

17. The timepiece of claim 1, including a diamond shaped crystal.

* * * * *